US007468122B2

(12) United States Patent
Byun et al.

(10) Patent No.: US 7,468,122 B2
(45) Date of Patent: Dec. 23, 2008

(54) COMPOSITE LAYER INCLUDING METAL AND INORGANIC POWDERS AND METHOD FOR MANUFACTURING THE SAME

(75) Inventors: Ji-Young Byun, Seoul (KR); Kyung-Tae Hong, Seoul (KR); Jung-Man Doh, Seoul (KR); Heon-Phil Ha, Guri-si (KR); Kyoung-Tae Kim, Seoul (KR)

(73) Assignee: KIST, Hawolgok-dong, Seongbuk-gu (KR)

( * ) Notice: Subject to any disclaimer, the term of this patent is extended or adjusted under 35 U.S.C. 154(b) by 228 days.

(21) Appl. No.: 11/322,881

(22) Filed: Dec. 29, 2005

(65) Prior Publication Data

US 2007/0108059 A1 May 17, 2007

(30) Foreign Application Priority Data

Nov. 15, 2005 (KR) ..... 10-2005-0109015

(51) Int. Cl.
*C25D 15/00* (2006.01)

(52) U.S. Cl. ..... 205/109

(58) Field of Classification Search ..... 428/411.1, 428/698, 702; 205/109
See application file for complete search history.

(56) References Cited

U.S. PATENT DOCUMENTS 3,505,177 A * 4/1970 Chester et al. ..... 205/73
3,591,350 A * 7/1971 Stareck et al. ..... 428/601
3,640,815 A * 2/1972 Schwartz et al. ..... 205/191
3,868,311 A * 2/1975 Durin ..... 205/109
3,891,542 A * 6/1975 Cordone et al. ..... 205/50
4,479,855 A * 10/1984 Thoma et al. ..... 205/109
7,022,417 B2 * 4/2006 Takagi et al. ..... 428/606

FOREIGN PATENT DOCUMENTS

EP 288364 A1 * 10/1988

OTHER PUBLICATIONS

Barmak et al., "Structure of Electrodeposited Graded Composite Coatings of Ni-Al-Al2O3", The Royal Microscopical Society, vol. 185, © (no month) 1997, pp. 265-274.*

* cited by examiner

*Primary Examiner*—Edna Wong
(74) *Attorney, Agent, or Firm*—Sheridan Ross P.C.

(57) ABSTRACT

The present invention relates to a composite layer including a metal and inorganic powders, and a method for manufacturing the same. The method for manufacturing a composite layer including a metal and inorganic powders includes step of preparing an electrolyte which includes nickel sulfamate [$Ni(NH_2SO_4)$] at 50.0 g/l~300.0 g/l, boric acid at 10.0 g/l~20.0 g/l, nickel chloride ($NiCl_2$) at 1.0 g/l~10.0 g/l, coumarin ($C_9H_6O_2$) at 0.02 g/l~0.5 g/l, sodium dodecyl sulfate [$CH_3$—$(CH_2)_{11}$—OSONa] at 4.0 g/l~60.0 g/l, sulfuric acid at 0.0 ml/l~150.0 ml/l, one or more inorganic powders selected from the group of alumina ($Al_2O_3$) and silicon carbide (SiC) at 20.0 g/l~70.0 g/l, and the remainder being distilled water. A basic metal to be coated with the composite metal is dipped into the electrolyte, and power is applied to the basic metal to electroplate the basic metal with the electrolyte to form a composite layer on the basic metal.

2 Claims, 3 Drawing Sheets

COMPOSITE LAYER INCLUDING METAL AND INORGANIC POWDERS AND METHOD FOR MANUFACTURING THE SAME

This application claims priority to Korean Patent Application No. 10-2005-0109015, filed on Nov. 15, 2005, and all the benefits accruing therefrom under 35 U.S.C. §119, and the contents of which in its entirety are herein incorporated by reference.

BACKGROUND OF THE INVENTION (a) Field of the Invention

The present invention relates to a composite layer including a metal and inorganic powders and a method for manufacturing the same, and more particularly to a composite layer in which the dispersing effect of the inorganic powders is good and the amount thereof can be freely controlled and a method for manufacturing the same.

(b) Description of the Related Art

Materials with complex properties are used in new technical fields and severe working conditions. In particular, materials with high strength are required to endure hot temperature conditions or highly corrosive conditions.

MMC (metal matrix composite), one of bulk materials which are suitable for the above working conditions, has been widely used since late 1960. MMC is a material in which two or more materials with different properties are mixed. There is an advantage that the MMC having a metal as a substrate has high strength and high hardness relative to a metal itself, and the physical properties thereof such as thermal expansion coefficient, thermal conductivity, and electrical conductivity can be controlled.

In order to expand the application field of the MMC, a method for improving internal or surface properties of the material has been developed. As new technologies have been developed, the method for improving a surface property among them has been heavily researched. In order to improve the surface property, a composite layer including a metal and inorganic powders is formed on a surface of a material. Oxides or carbides are used as the inorganic powders. The method for improving industrial adaptability has been variably researched by combining benefits of the metal and the inorganic powders.

The methods of chemical vapor deposition (CVD), physical vapor deposition (PVD), plasma deposition, painting, etc., have been used in order to form a composite layer on the surface of the material. However, there are problems that the above methods consume a large amount of money and the quality of the manufactured composite layer is poor. In particular, there is a problem that the composite layer is difficult to apply to industry since an amount of the inorganic materials included in the composite layer is limited.

BRIEF SUMMARY OF THE INVENTION

The present invention is contrived to solve the above problems, and to provide a composite layer in which it is possible to freely control the amount of inorganic powders included therein.

In addition, the present invention is contrived to provide a method for manufacturing the above composite layer.

The present invention relates to a method for manufacturing a composite layer including a metal and inorganic powders. The method for manufacturing a composite layer including a metal and inorganic powders includes steps of preparing an electrolyte including nickel sulfamate [Ni $(NH_2SO_4)$] at 50.0 g/l~300.0 g/l, boric acid at 10.0 g/l~20.0 g/l, nickel chloride ($NiCl_2$) at 1.0 g/l~10.0 g/l, coumarin ($C_9H_6O_2$) at 0.02 g/l~0.5 g/l, sodium dodecyl sulfate [$CH_3$—$(CH_2)_{11}$—OSONa] at 4.0 g/L~60.0 g/l, sulfuric acid at 0.0 ml/l~150.0 ml/l, one or more inorganic powders at 20.0 g/l~70.0 g/l selected from the group of alumina ($Al_2O_3$) and silicon carbide (SiC), and the remainder of distilled water; dipping a basic metal into the electrolyte; supplying power to the basic metal and electroplating the basic material; and forming the composite layer on the basic metal.

The amount of sodium dodecyl sulfate is preferably in the range of 25.0 g/l to 50.0 g/l in the step of preparing the electrolyte.

The grain size of the inorganic powder is preferably in the range of 0.3 μm to 10.0 μm in the step of preparing the electrolyte.

A volume ratio of the inorganic powders included in the composite layer is increased and then decreased as an adding amount of the sulfuric acid is increased in the step of forming the composite layer on the basic metal.

If the inorganic powder is silicon carbide, the volume ratio of the inorganic powder is preferably increased to a point where the amount of sulfuric acid is substantially 70.0 ml/l and is then decreased.

If the inorganic powder is alumina, the volume ratio of the inorganic powder is preferably increased to a point where the amount of the sulfuric acid is substantially 100.0 ml/l and is then decreased.

It is preferable that a substrate of the composite layer is nickel, the inorganic powder is silicon carbide, and the volume ratio of the silicon carbide in the composite layer is not more than 80.0 vol % in the step of forming the composite layer on the basic metal.

It is preferable that a substrate of the composite layer is nickel, the inorganic powder is alumina, and the volume ratio of the alumina in the composite layer is not more than 40.0 vol % in the step of forming the composite layer on the basic metal.

The composite layer can be manufactured by using the above method.

BRIEF DESCRIPTION OF THE DRAWINGS

The above and other features and advantages of the present invention will become more apparent by describing exemplary embodiments thereof in detail with reference to the attached drawings, in which.

DETAILED DESCRIPTION OF THE INVENTION

Now, exemplary embodiments of the present invention will be described with reference to the attached drawings in order for those skilled in the art to work out the present invention. However, the present invention can be embodied in various modifications and thus is not limited to the embodiments described below.

According to the present invention, an electroplating method is used in order to form a composite layer on the basic material. Since the electroplating method has an advantage that an installation cost and a maintaining cost are not large, industrial applicability thereof is high. The composite layer can be formed on the basic material using electrical energy.

Figure 1:
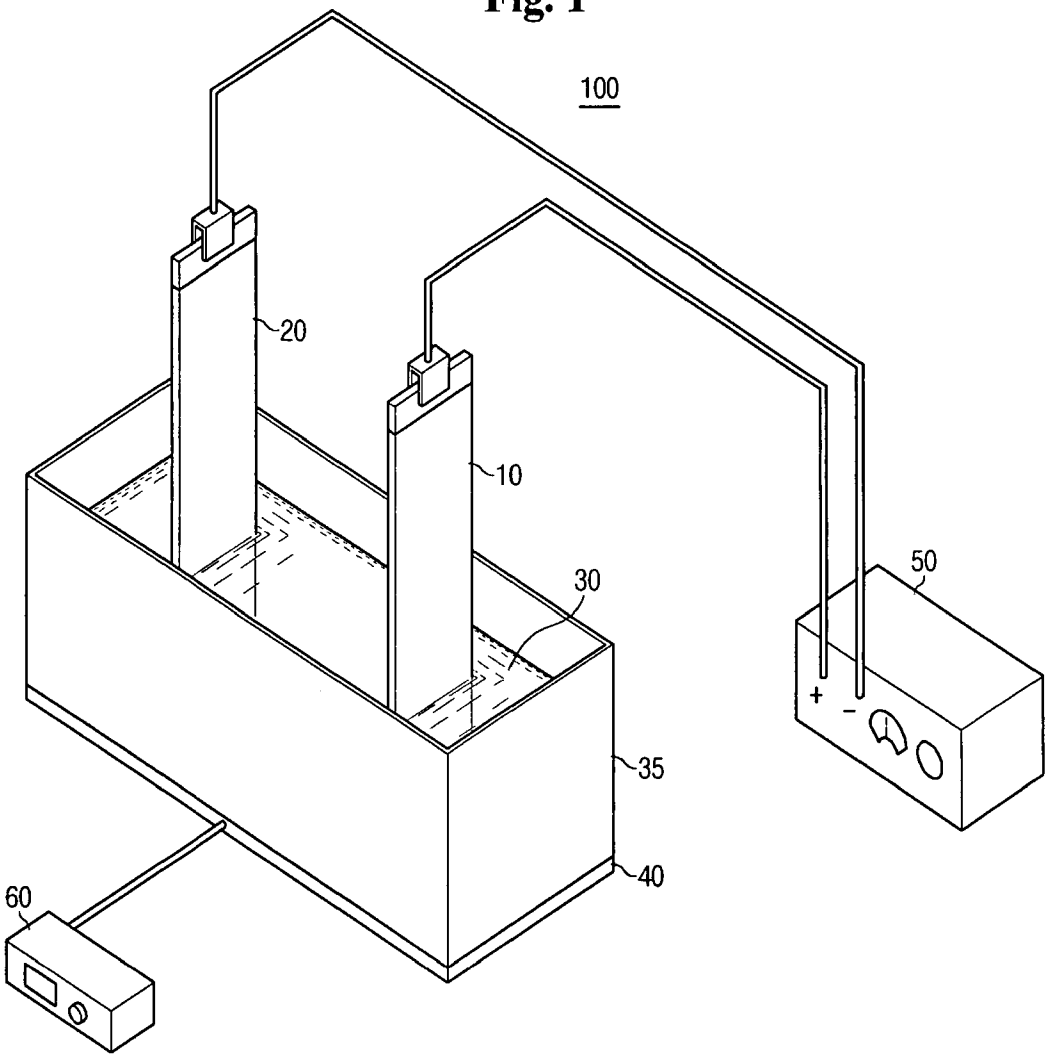
FIG. 1 schematically shows an apparatus for manufacturing a composite layer according to an embodiment of the present invention.

FIG. 1 schematically shows an apparatus for manufacturing a composite layer 100 according to an embodiment of the present invention. The apparatus for manufacturing a composite layer 100 is an apparatus for electroplating. The apparatus for manufacturing a composite layer 100 shown in FIG. 1 is merely to illustrate the present invention, and the present invention is not limited thereto. Therefore, the apparatus for manufacturing a composite layer 100 can be modified to other forms.

The apparatus for manufacturing a composite layer 100 includes a direct current power supply 50, a temperature controlling device 60, an electrolyte vessel 35, a hotplate 40, and so on. The direct current power supply 50 is connected to a positive plate 10 and a negative plate 20 and supplies electrical power thereto. The temperature controlling device 60 is electrically connected to the hotplate 40. The hotplate 40 is located below the electrolyte vessel 35 and heats the electrolyte 30 contained therein. The temperature controlling device 60 controls the temperature of electrolyte 30. Since the structures of the direct current power supply 50, the temperature controlling device 60, and the hotplate 40 can be easily understood by those skilled in the art, detailed explanations thereof are omitted.

After the positive plate 10 and the negative plate 20 are electrically connected to the direct current power supply 50, the positive plate 10 and the negative plate 20 are dipped into the electrolyte 30, of which the temperature is controlled. In this case, a metal and inorganic powders are electrically coated on a surface of the negative plate 20. A basic metal is used as the negative plate 20. Since the basic metal is conductive, it is suitable for electroplating. A soluble metal or an insoluble metal is used as the positive plate 10.

According to the present invention, nickel which has good corrosion resistance is used as a substrate of the composite layer. Therefore, the electrolyte 30 for electroplating includes nickel compounds.

The electrolyte 30 includes nickel sulfamate [$Ni(NH_2SO_4)$], boric acid, a nickel chloride ($NiCl_2$), coumarin ($C_9H_6O_2$), sodium dodecyl sulfate [$CH_3$—$(CH_2)_{11}$—OSONa], sulfuric acid, and inorganic powders, and the rest thereof is distilled water. In addition, other chemical materials can be added if necessary to prepare the electrolyte 30.

A nickel substrate is formed by using nickel sulfate. The nickel sulfate, in an amount within the range of 50.0 g/l to 300.0 g/l, can be added to the electrolyte. If the amount of nickel sulfate is less than 50.0 g/l, the coating rate becomes slow. If the amount of nickel sulfate is more than 300.0 g/l, the nickel sulfate is not completely dissolved in the distilled water. In particular, it is preferable that nickel sulfate is present in the range of 150.0 g/l to 250.0 g/l so that it is possible for a nickel substrate having good quality to be formed on the negative plate 20.

The boric acid and the nickel chloride are added in small amounts to improve the quality of the coating layer. The amount of boric acid is preferably in the range of 10.0 g/l to 20.0 g/l. If the amount of boric acid is less than 10.0 g/l or more than 20.0 g/l the coating layer is not densely formed, so the quality of the coating layer is deteriorated. Furthermore, it is preferable that the amount of nickel chloride is in the range of 1.0 g/l to 10.0 g/l. If the amount of nickel chloride is less than 1.0 g/l or more than 1.0 g/l the quality of the coating layer is deteriorated, so the composite layer does not have desired properties.

The coumarin, the sodium dodecyl sulfate, and the sulfuric acid are added as dispersing agents. It is preferable that the amount of added coumarin is in the range of 0.02 g/l to 0.5 g/l. If the amount of coumarin is less than 0.02 g/l the inorganic materials cannot be mixed well in the coating layer, and if the amount of coumarin is more than 0.5 g/l it is not uniformly dispersed in the electrolyte. Also, it is preferable that the amount of added sodium dodecyl sulfate is in the range of 4.0 g/l to 60.0 g/l. If the amount of sodium dodecyl sulfate is less than 4.0 g/l the inorganic materials are not mixed in the coating layer, and if the amount of sodium dodecyl sulfate is more than 60.0 g/l it is not uniformly dispersed in the electrolyte. In particular, it is more preferable that the amount of added sodium dodecyl sulfate is in the range of 25.0 g/l to 50.0 g/l.

In addition, an amount of inorganic powders in the composite layer can be controlled by controlling the amount of sulfuric acid. It is preferable that the sulfuric acid is present at more than 0.0 ml/l and not more than 150.0 ml/l in order to control the amount of inorganic powders. The amount of sulfuric acid added is varied depending on the kinds of inorganic powders. If the inorganic powder is silicon carbide, it is preferable that the sulfuric acid is added at not more than 70.0 ml/l. If the sulfuric acid is added to over 70.0 ml/l, it is difficult to control the amount of silicon carbide in the composite layer. If the inorganic powder is alumina, it is preferable that the sulfuric acid is added at not more than 100.0 ml/l. If the sulfuric acid is added to over 100.0 ml/l, it is difficult to control the amount of alumina in the composite layer.

One or more inorganic powders selected from the group of alumina and silicon carbide is added to the electrolyte in order to add inorganic powders to the composite layer. The inorganic powders have a grain size in the range of 0.3 μm to 10.0 μm. If the grain size of the inorganic powders is less than 0.3 μm, the manufacturing cost is high. If the grain size of the inorganic powders is more than 10.0 μm, the inorganic powders are not dispersed well in the electrolyte.

In addition, it is preferable that the amount of added inorganic powders is in the range of 20.0 g/l to 70.0 g/l. If the amount of inorganic powders is less than 20.0 g/l, it is difficult to form a composite layer. If the amount of inorganic powder is more than 70.0 g/l, they are not uniformly dispersed and are agglomerated.

The basic metal, which is the negative plate 20, is dipped in the electrolyte 30 which is prepared as described above. Next, electrical power is supplied to the basic metal, and thereby the basic metal is electrically coated. The composite layer can be formed on the basic metal by electroplating. According to the present invention, the amount of inorganic powders in the composite layer can be freely controlled when the composite layer is electroplated on the basic metal.

The experimental examples of the present invention will be explained below. The experimental examples of the present invention are merely to illustrate the present invention, and the present invention is not limited thereto.

EXPERIMENTAL EXAMPLES

An experiment was carried out by using an apparatus for manufacturing a composite layer shown in FIG. 1. The electrolyte was manufactured by adding 200.0 g of nickel sulfate, 15.5 g of boric acid, 2.4 g of nickel chloride, and 0.05 g of coumarin to 1000.0 ml of distilled water. The electrolyte was heated to at least 50° C. while being stirred by a magnetic bar. After the chemical compounds that were added to the distilled water were completely dissolved, 40.0 g of sodium dodecyl sulfate was added and the electrolyte was maintained at 40.0° C. until the sodium dodecyl sulfate was completely dissolved.

Next, 30.0 g of silicon carbide powders or alumina powders with a grain size of 1.0 μm were added, followed by the slow addition of sulfuric acid. The temperature of the electrolyte was substantially maintained at 40° C., and thereby electrolyte with completely dissolved components was manufactured.

A positive plate and a negative plate each made of copper were dipped in the electrolyte. A direct current power supply was electrically connected to the positive plate and the negative plate, and electrical power was supplied thereto. The negative plate was electroplated for six hours while the temperature of the electrolyte was maintained at 40° C.

After the electroplating of the negative plate was completed, the coating layer thereof was cut in a vertical direction. The shape and the composition of the coating layer were analyzed by an electron probe microanalysis (EPMA) method. Various experimental examples of the present invention are explained below.

Experimental Example 1

Silicon carbide powder was used as the inorganic powder, and 15.0 ml of sulfuric acid was added. The rest of the experimental conditions were the same as described above.

Experimental Example 2

Silicon carbide powder was used as the inorganic powder, and 30.0 ml of sulfuric acid was added. The rest of the experimental conditions were the same as described above.

Experimental Example 3

Silicon carbide powder was used as the inorganic powder, and 50.0 ml of sulfuric acid was added. The rest of the experimental conditions were the same as described above.

Experimental Example 4

Silicon carbide powder was used as the inorganic powder, and 70.0 ml of sulfuric acid was added. The rest of the experimental conditions were the same as described above.

Experimental Example 5

Silicon carbide powder was used as the inorganic powder, and 100.0 ml of sulfuric acid was added. The rest of the experimental conditions were the same as described above.

Experimental Example 6

Silicon carbide powder was used as the inorganic powder, and 150.0 ml of sulfuric acid was added. The rest of the experimental conditions were the same as described above.

Experimental Example 7

Alumina powder was used as the inorganic powder, and 15.0 ml of sulfuric acid was added. The rest of the experimental conditions were the same as described above.

Experimental Example 8

Alumina powder was used as the inorganic powder, and 30.0 ml of sulfuric acid was added. The rest of the experimental conditions were the same as described above.

Experimental Example 9

Alumina powder was used as the inorganic powder, and 50.0 ml of sulfuric acid was added. The rest of the experimental conditions were the same as described above.

Experimental Example 10

Alumina powder was used as the inorganic powder, and 70.0 ml of sulfuric acid was added. The rest of the experimental conditions were the same as described above.

Experimental Example 11

Alumina powder was used as the inorganic powder, and 100.0 ml of sulfuric acid was added. The rest of the experimental conditions were the same as described above.

Experimental Example 12

Alumina powder was used as the inorganic powder, and 150.0 ml of sulfuric acid was added. The rest of the experimental conditions were the same as described above.

COMPARATIVE EXAMPLES

Electroplating was carried out by using an electrolyte with sulfuric acid according to the prior art in order to compare the present invention with the prior art. The experimental conditions were the same as in the experimental examples of the present invention, except sulfuric acid was not added to the electrolyte.

Comparative Example 1

Silicon carbide powder was used as the inorganic powder. The rest of the experimental conditions were the same as described above.

Comparative Example 2

Alumina powder was used as the inorganic powder. The rest of the experimental conditions were the same as described above.

Figure 2:
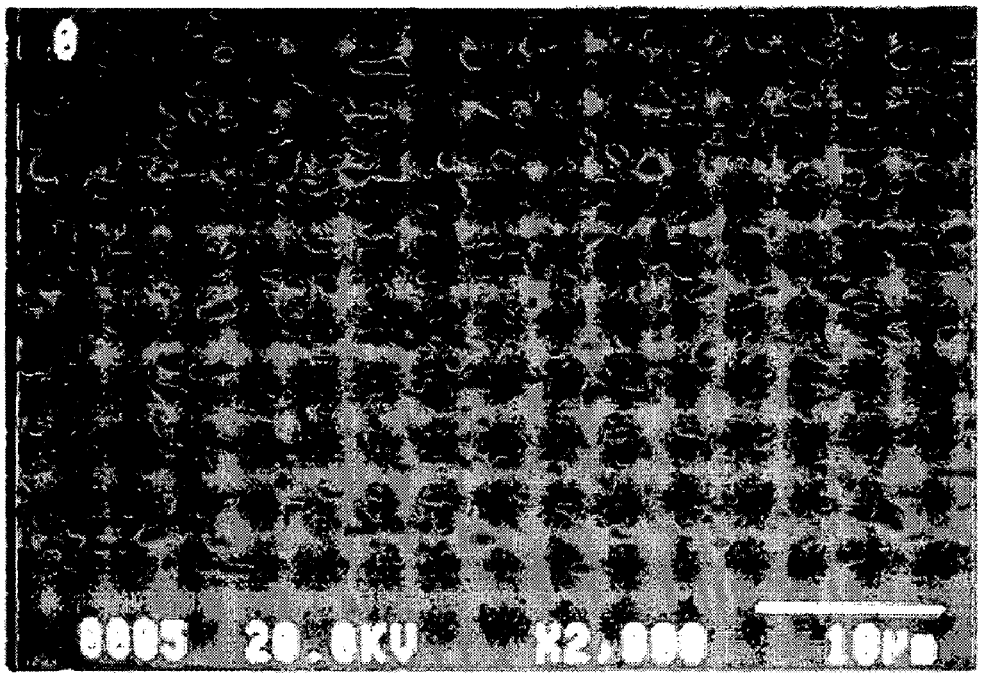
FIG. 2 is a photograph taken by a scanning electron microscope (SEM) of a composite layer which is manufactured according to a first experimental example of the present invention.

FIG. 2 shows a photograph of the composite layer taken by a SEM according to Experimental Example 1 of the present invention. The white portion of FIG. 2 represents a nickel matrix, while the dark portion of FIG. 2 represents silicon carbide mixed in the matrix. As shown in FIG. 2, the silicon carbide was uniformly dispersed in a nickel matrix. Therefore, when the composite layer was manufactured by Experimental Example 1 of the present invention, a composite layer having good quality was produced. Similar results were obtained with Experimental Examples 2 to 12 of the present invention.

Figure 3:
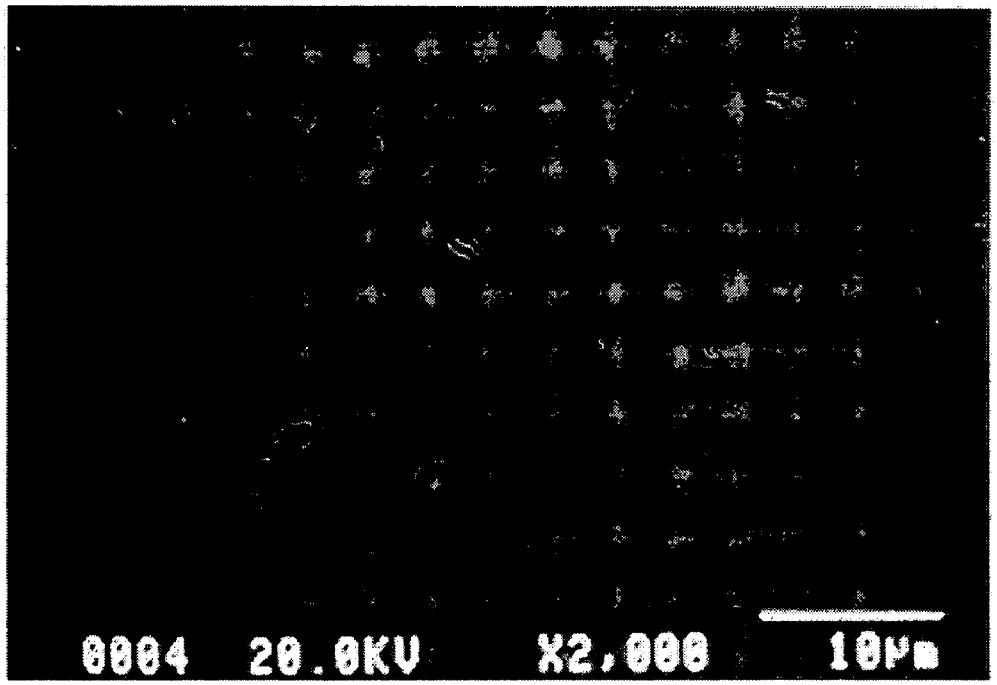
FIG. 3 is a photograph taken by a SEM of a composite layer which is manufactured according to a first comparative example of a prior art.

FIG. 3 shows a SEM photograph of a composite layer manufactured according to Comparative Example 1 of the prior art. As shown in FIG. 3, silicon carbide was not uniformly mixed in the nickel matrix. In addition, the amount of silicon carbide mixed in the nickel matrix was small. Therefore, a composite layer having poor quality was manufactured.

As described above, a composite layer having good quality can be manufactured by adding sulfuric acid to the electrolyte. The volume ratios of the inorganic powder incorporated into the composite layer formed by electroplating according to the amount of sulfuric acid added to the electrolyte is shown in Table 1.

TABLE 1

| NO | Experimental examples/ Comparative examples | amount of sulfuric acid added (ml/l) | volume ratio of inorganic powder (vol %) |
|---|---|---|---|
| 1 | Experimental Example 1 | 15.0 | 17.0 |
| 2 | Experimental Example 2 | 30.0 | 40.0 |
| 3 | Experimental Example 3 | 50.0 | 60.0 |
| 4 | Experimental Example 4 | 70.0 | 80.0 |
| 5 | Experimental Example 5 | 100.0 | 64.0 |
| 6 | Experimental Example 6 | 150.0 | 39.0 |
| 7 | Experimental Example 7 | 15.0 | 5.0 |
| 8 | Experimental Example 8 | 30.0 | 16.0 |
| 9 | Experimental Example 9 | 50.0 | 26.0 |
| 10 | Experimental Example 10 | 70.0 | 35.0 |
| 11 | Experimental Example 11 | 100.0 | 40.0 |
| 12 | Experimental Example 12 | 150.0 | 23.0 |
| 13 | Comparative Example 1 | 0.0 | 3.0 |
| 14 | Comparative Example 2 | 0.0 | 5.0 |

As shown in Table 1, the volume ratio of silicon carbide in the composite layer was controlled such that the amount thereof was not more than 80.0 vol % in Experimental Examples 1 to 6 of the present invention. In addition, the volume ratio of alumina in the composite layer was controlled such that the amount thereof was not more than 40.0 vol % in Experimental Examples 7 to 12 of the present invention. As described above, the volume ratio of the inorganic powders in a composite layer could be maximized according to the present invention.

Figure 4:
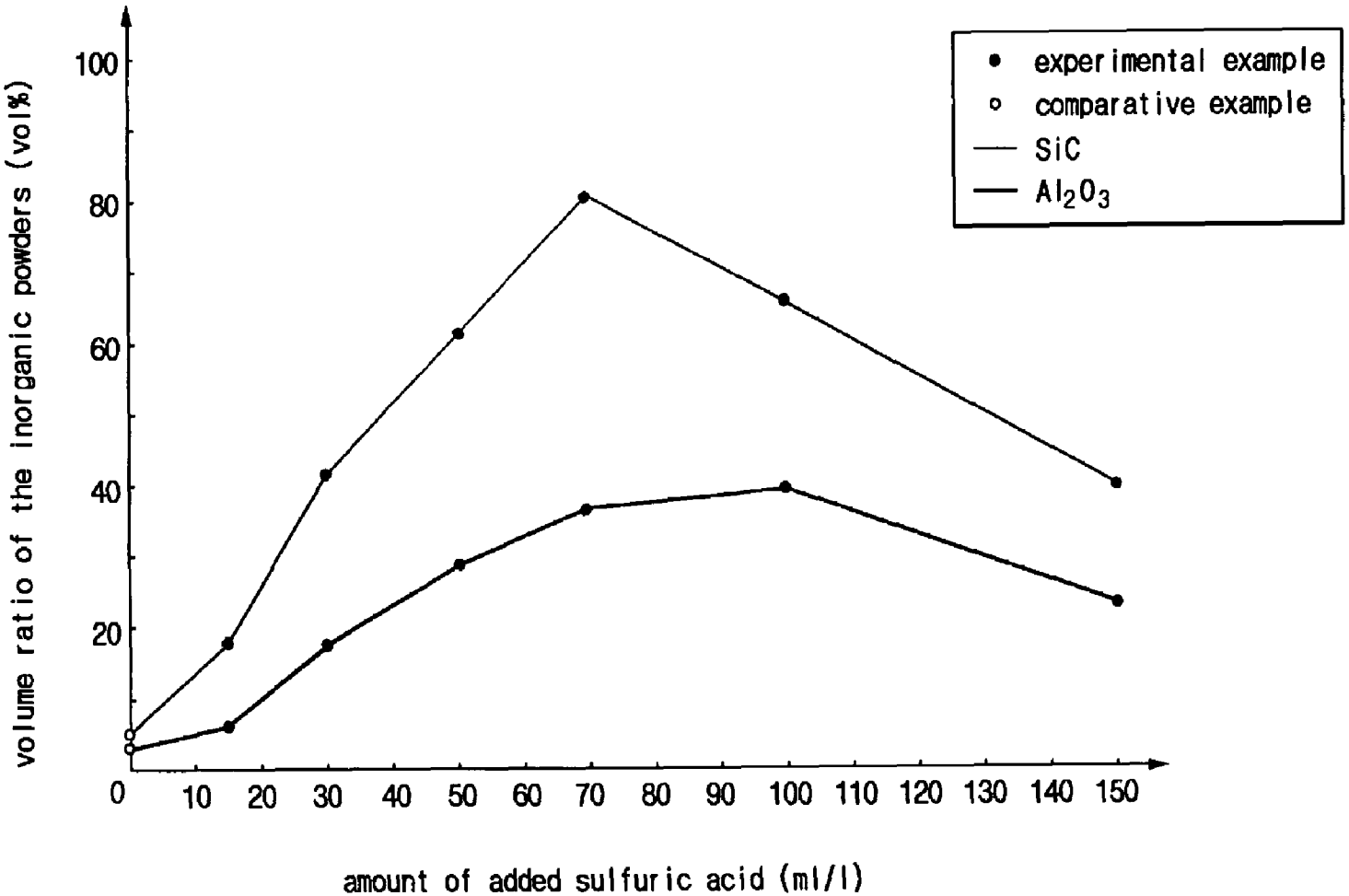
FIG. 4 is a graph showing a relationship between an adding amount of sulfuric acid and a volume ratio of inorganic powders in the composite layer in the first experimental example of the present invention and the first comparative example of the prior art.

FIG. 4 graphically shows the data of Table 1. FIG. 4 shows a relationship between the amount of sulfuric acid added to the electrolyte and the volume ratio of the inorganic powders incorporated into the composite layer according to experimental examples of the present invention and comparative examples of the prior art, respectively. The composite layers manufactured according to Experimental Examples 1 to 12 were analyzed by the EPMA method and then the volume ratio of the inorganic powders in a composite layer was obtained. In FIG. 4, the thin line denotes the case in which silicon carbide was used as an inorganic powder, while the thicker, solid line denotes the case in which alumina was used as an inorganic powder. • of FIG. 4 denotes Experimental Examples 1 to 12 of the present invention, and ○ of FIG. 4 denotes Comparative Examples 1 and 2 of the prior art.

As shown in FIG. 4, the volume ratio of the inorganic powders incorporated into the composite layer increased and then decreased as the amount of sulfuric acid added to the electrolyte solution was increased. That is, as the amount of sulfuric acid was increased, the volume ratio of the silicon carbide or the alumina in the composite layer increased to a certain point and then decreased. The volume ratio of the silicon carbide increased to the point where the amount of sulfuric acid was substantially 70.0 ml/l and then decreased. Here, the above phrase "substantially 70.0 ml/l" means that it is 70.0 ml/l or it is near 70.0 ml/l. In addition, the volume ratio of the alumina increased to the point where the amount of sulfuric acid was substantially 100.0 ml/l and then decreased.

Therefore, the volume ratio of the inorganic powders in the composite layer can be controlled by controlling the amount of the sulfuric acid used during electroplating. Because the physical properties of the composite layers differ depending on the volume ratio of the inorganic powders in the composite layers, a composite layer that is suitable for the various technical fields can be manufactured by simply controlling the amount of sulfuric acid added to the electrolyte. However, the amount of sulfuric acid added to the electrolyte is limited to a certain concentration range as described above.

For example, a large amount of sulfuric acid can be added to the electrolyte in order to increase the amount of inorganic powders for surroundings where heat-resistance is more important than strength. On the contrary, a small amount of sulfuric acid can be added to the electrolyte in order to decrease the amount of inorganic powders for surroundings where strength is more important than heat-resistance. A composite layer that is suitable for each working environment can therefore be manufactured by using the above method.

There is an advantage that the amount of inorganic powders in the composite layer can be freely controlled by controlling the amount of sulfuric acid added according to a method for manufacturing a composite layer of the present invention. Therefore, composite layers that have suitable properties for certain environments can be freely manufactured. In addition, it is possible to manufacture a composite layer including a large amount of the inorganic powders.

The composite layer manufactured according to a method for manufacturing a composite layer of the present invention is suitable for various working conditions since the amount of inorganic powders thereof is controlled during manufacture.

Although the exemplary embodiments of the present invention have been described, it can be easily understood by those skilled in the art that the present invention may be modified in various forms without departing from the spirit and scope of the appended claims. Moreover, the use of the terms first, second, etc., do not denote any order or importance, but rather the terms first, second, etc., are used to distinguish one element from another. Furthermore, the use of the terms a, an, etc., do not denote a limitation of quantity, but rather denote the presence of at least one of the referenced item.

What is claimed is:

1. A method of manufacturing a composite layer on a basic metal substrate comprising:

dipping a basic metal into an electrolyte comprising:

nickel sulfamate [$Ni(NH_2SO_4)$] in a concentration range of 50.0 g/l to 300.0 g/l; boric acid in a concentration range of 10.0 g/l to 20.0 g/l;

nickel chloride ($NiCl_2$) in a concentration range of 1.0 g/l to 10.0 g/l;

coumarin ($C_9H_6O_2$) in a concentration range of 0.02 g/l to 0.5 g/l;

sodium dodecyl sulfate [$CH_3$—$(CH_2)_{11}$—OSONa] in a concentration range of 4.0 g/l to 60.0 g/l;

an inorganic silicon carbide (SiC) powder and in a concentration range of 20.0 g/l to 70.0 g/l;

sulfuric acid in a concentration range of 15.0 ml/l to 70.0 ml/l; and, distilled water; and electroplating the basic metal substrate to form a nickel-alumina composite layer on the basic metal.

2. The method of claim 1, wherein the inorganic silicon carbide powder in the electrolyte has a grain size between 0.3 μm and 10.0 μm.

* * * * *